United States Patent [19]

Bleeke

[11] 4,304,201

[45] Dec. 8, 1981

[54] METHOD AND APPARATUS FOR STEP POSITIONING AN ENGINE SPEED CONTROL

[75] Inventor: William F. Bleeke, Vandalia, Mich.

[73] Assignee: CTS Corporation, Elkhart, Ind.

[21] Appl. No.: 158,077

[22] Filed: Jun. 10, 1980

[51] Int. Cl.[3] ..... F02B 77/00; F02D 11/08; F02D 1/04

[52] U.S. Cl. ..... 123/339; 123/DIG. 11; 123/198 D; 123/198 DB

[58] Field of Search ..... 123/339, 340, 342, 395, 123/396, 399, 403, 179 G, 198 D, 198 DB, 350, DIG. 11; 335/259, 267, 266, 268; 251/284

[56] References Cited

U.S. PATENT DOCUMENTS

| | | | |
|---|---|---|---|
| 2,359,925 | 10/1944 | Leibing | 261/41 |
| 2,804,552 | 8/1957 | McFarland | 123/339 |
| 2,804,553 | 8/1957 | McFarland | 123/339 |
| 3,253,772 | 5/1966 | Parker | 123/339 |
| 3,304,068 | 2/1967 | Thomas | 261/41 |
| 3,730,153 | 5/1973 | Harrison et al. | 123/339 |
| 3,760,785 | 9/1973 | Harrison et al. | 123/198 DB |
| 3,800,759 | 4/1974 | Cedar | 123/339 |
| 3,841,281 | 10/1974 | Mick | 123/DIG. 11 |
| 3,895,615 | 7/1975 | Schubeck | 123/DIG. 11 |
| 3,971,356 | 7/1976 | Schlage | 123/198 D |
| 4,016,852 | 4/1977 | Konishi et al. | 123/DIG. 11 |
| 4,022,179 | 5/1977 | Kalert et al. | 123/198 D |
| 4,060,063 | 11/1977 | Hirasawa | 123/97 B |
| 4,067,306 | 1/1978 | Berich et al. | 123/198 D |
| 4,086,900 | 5/1978 | Marsh | 123/198 D |
| 4,108,127 | 8/1978 | Chapin et al. | 123/339 |
| 4,122,819 | 10/1978 | Moshofsky et al. | 123/198 D |
| 4,128,087 | 12/1978 | Hayashi et al. | 123/103 E |
| 4,181,104 | 1/1980 | Shenoda | 123/102 |
| 4,196,704 | 4/1980 | Cook | 123/339 |
| 4,237,833 | 12/1980 | Des Lauries | 123/339 |

*Primary Examiner*—Raymond A. Nelli

*Attorney, Agent, or Firm*—John A. Young; Larry J. Palguta

[57] ABSTRACT

A multi-stage latching device for a carburetor which controls the idle speed by defining various throttle plate positions according to deceleration sensor switch, air conditioning switch and ignition switch states. The mechanism which moves the throttle plate consists of a primary force coil which energizes an armature against spring return and the position of the armature coupled through a shaft establishes the idle speed. The throttle position is determined by any one of three adjustably disposed latch coils which when energized, magnetically couple to a casing to define a stop. A circuit control associated with each latch deenergizes the primary force coil while maintaining the magnetic coupling of the stop. With primary force off, the return spring forces the armature back against the energized stop and hence establishes the throttle position and idle speed.

19 Claims, 9 Drawing Figures

METHOD AND APPARATUS FOR STEP POSITIONING AN ENGINE SPEED CONTROL

BACKGROUND OF THE INVENTION

There are numerous fuel supply and carburetor linkage control mechanisms all of which are intended to control the position of a throttle to effect an appropriate engine idle speed. Idle speed controls operable by solenoid operated devices have been widely proposed. In still other engine idle speed controls, control means have been adapted to operate from an output signal derived from an input signal which represents a given engine speed, thereby accomplishing a feedback control of engine idling speed. In still other throttle positioning devices, various diaphragm means have been used to establish a throttle position. These expedients, the usage of feedback control signals, have achieved various degrees of success. But the basic approaches of these various prior art devices is discarded in the present invention in favor of a latching mechanism wherein a latching device develops a defined extended position for a throttle control. This defined position is intended to define specific idle positions of the throttle.

SUMMARY OF THE INVENTION

The present invention effects a calibrated idle position which is specific to a required condition, for example, a high load demand on the engine which occurs when air conditioning is turned on; or, when the engine is coming down from a high speed by sudden braking and abrupt deceleration to completely burn fuel in the manifold; or, simply when the ignition switch is "on" and the engine ought to be idled at an appropriate no load speed; or, when the ignition is switched "off" to prevent dieselling. The positioning for these distinctly different conditions is calibrated in part to the engine operating modes and is independent of feedback sensors, microprocessors and other such controls for establishing the idle speed setting of an engine.

An object of the present invention is to provide through an open loop control system any one of various defined positions of a throttle plate which are appropriate to a particular power demand on the engine and/or its operating mode.

A further object of the present invention is to provide a magnetic latching device which has a low electrical power requirement, but is operable on a two stage basis, the one stage being effected by a primary force coil which necessitates an intermittent high electrical power demand but once properly positioned the idle speed control is latched in a given holding position to maintain a precise idle condition wherein the latching mechanism is characterized by a low power or current demand. Thus, it is an important feature of the present invention that the control device of the present invention necessitates only a transient high electrical power requirement for effecting proper throttle positioning to obtain calibrated engine idle speed according to engine operating modes, but to maintain that idle speed, there is a much lower electrical power requirement. The result is that the device adds only slightly to the electrical system load and can be small in size due to its low average electrical power dissipation.

Other objects and features of the present invention will become apparent from a consideration of the following description which proceeds with reference to the accompanying drawings wherein selected example embodiments of the invention are used to illustrate the invention.

DRAWINGS

Figure 5:
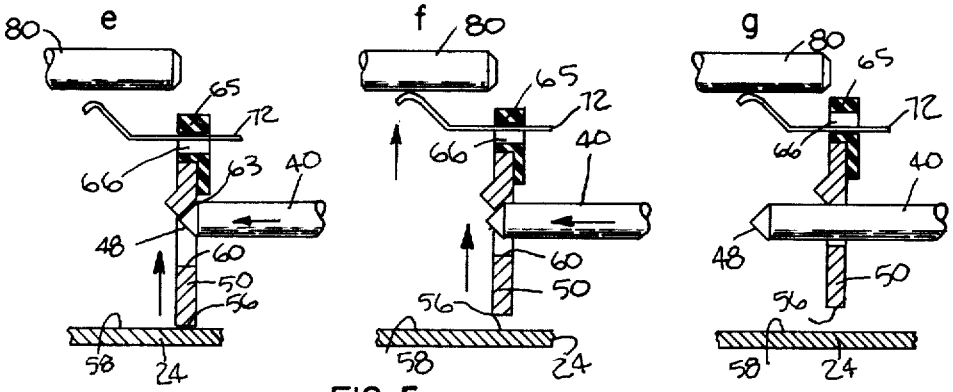
Figure 6:
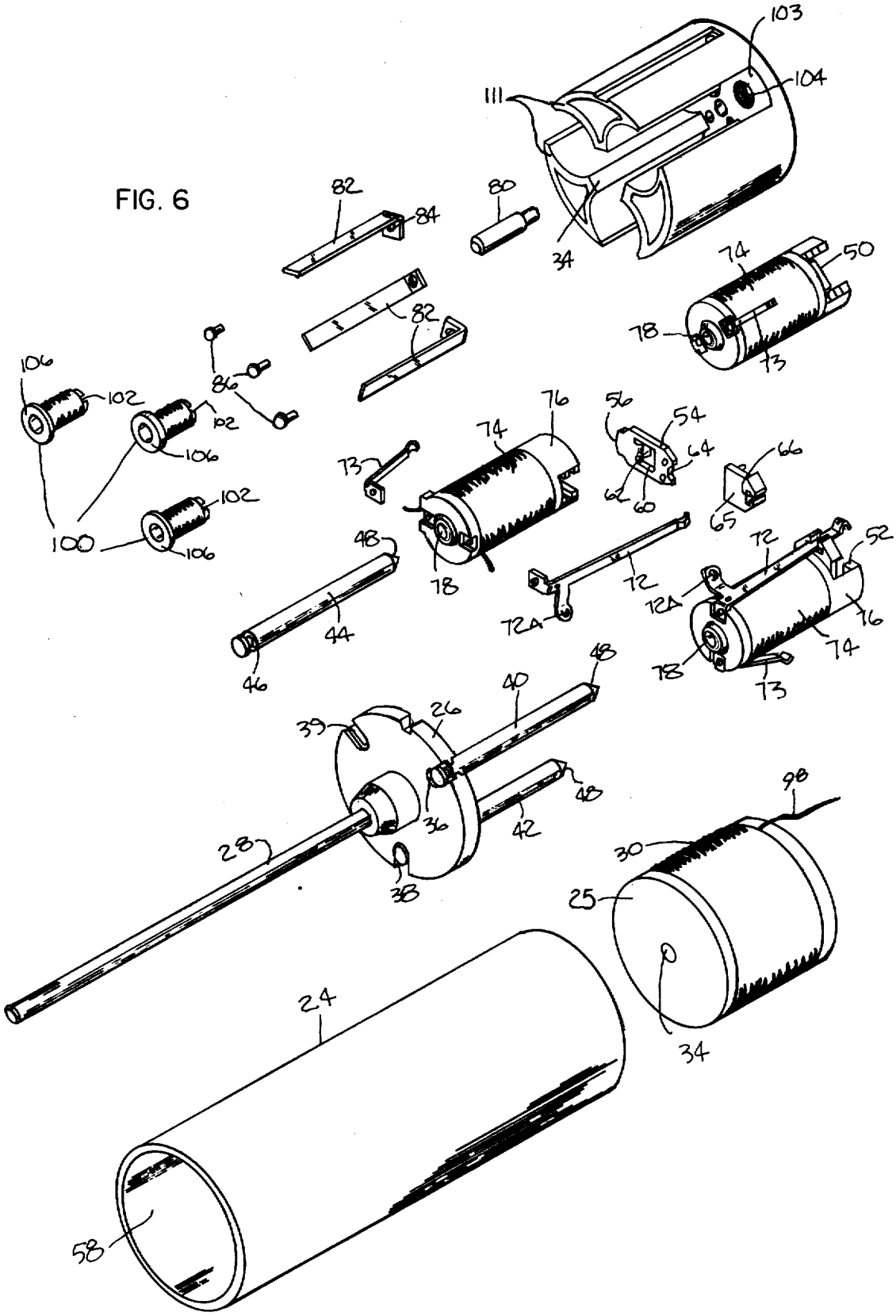
Figure 7:
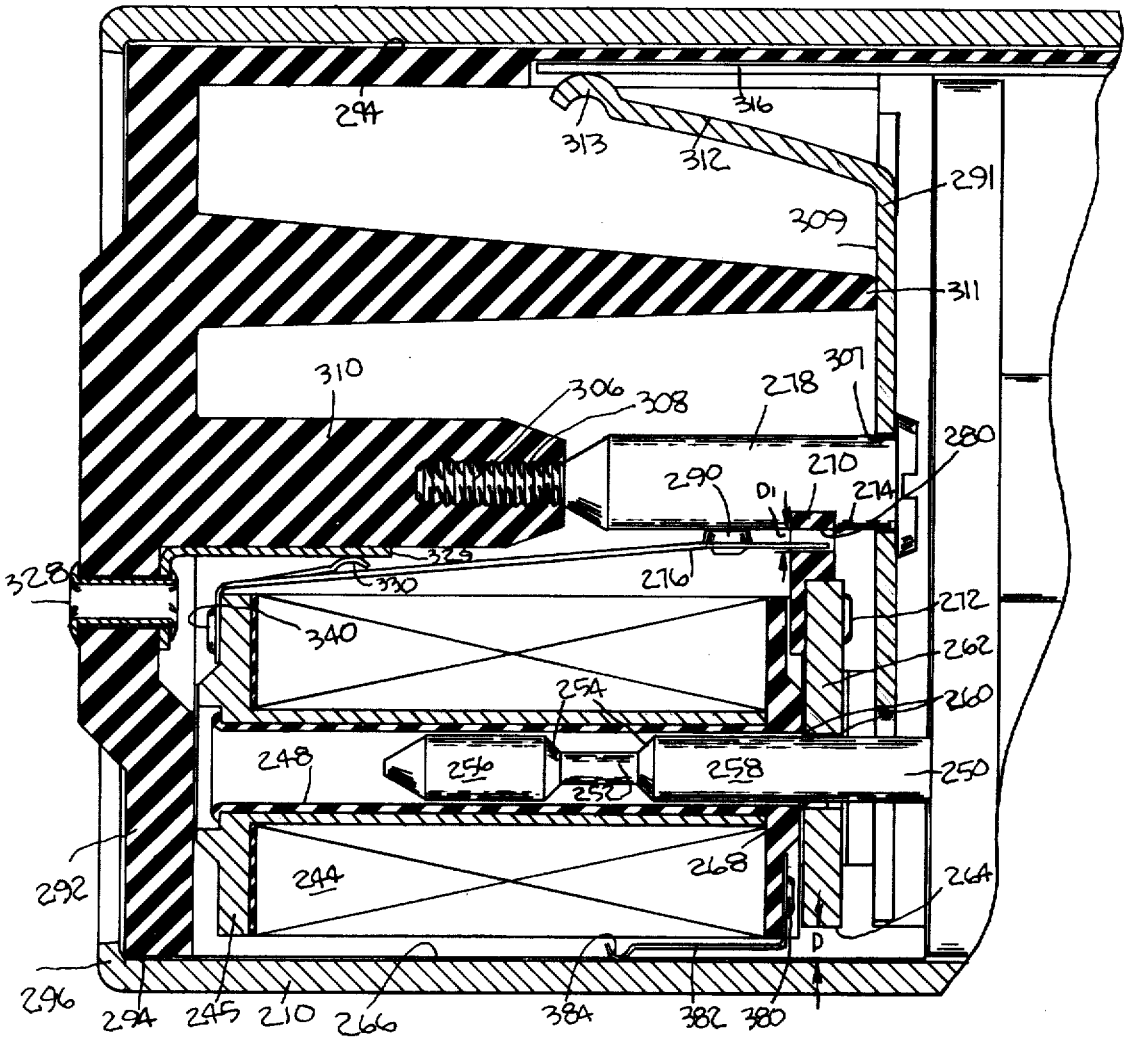
Figure 8:
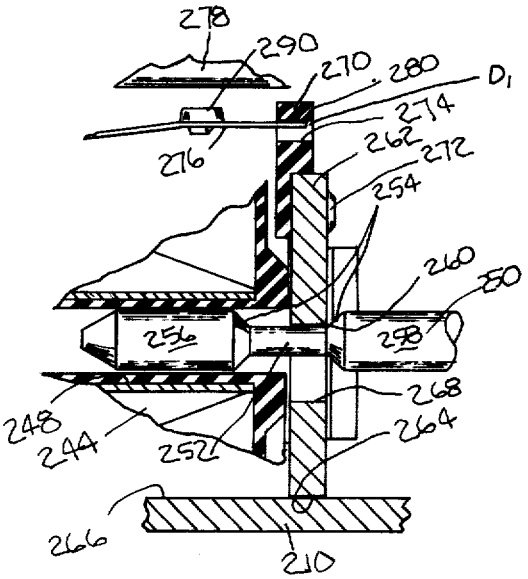
Figure 9:
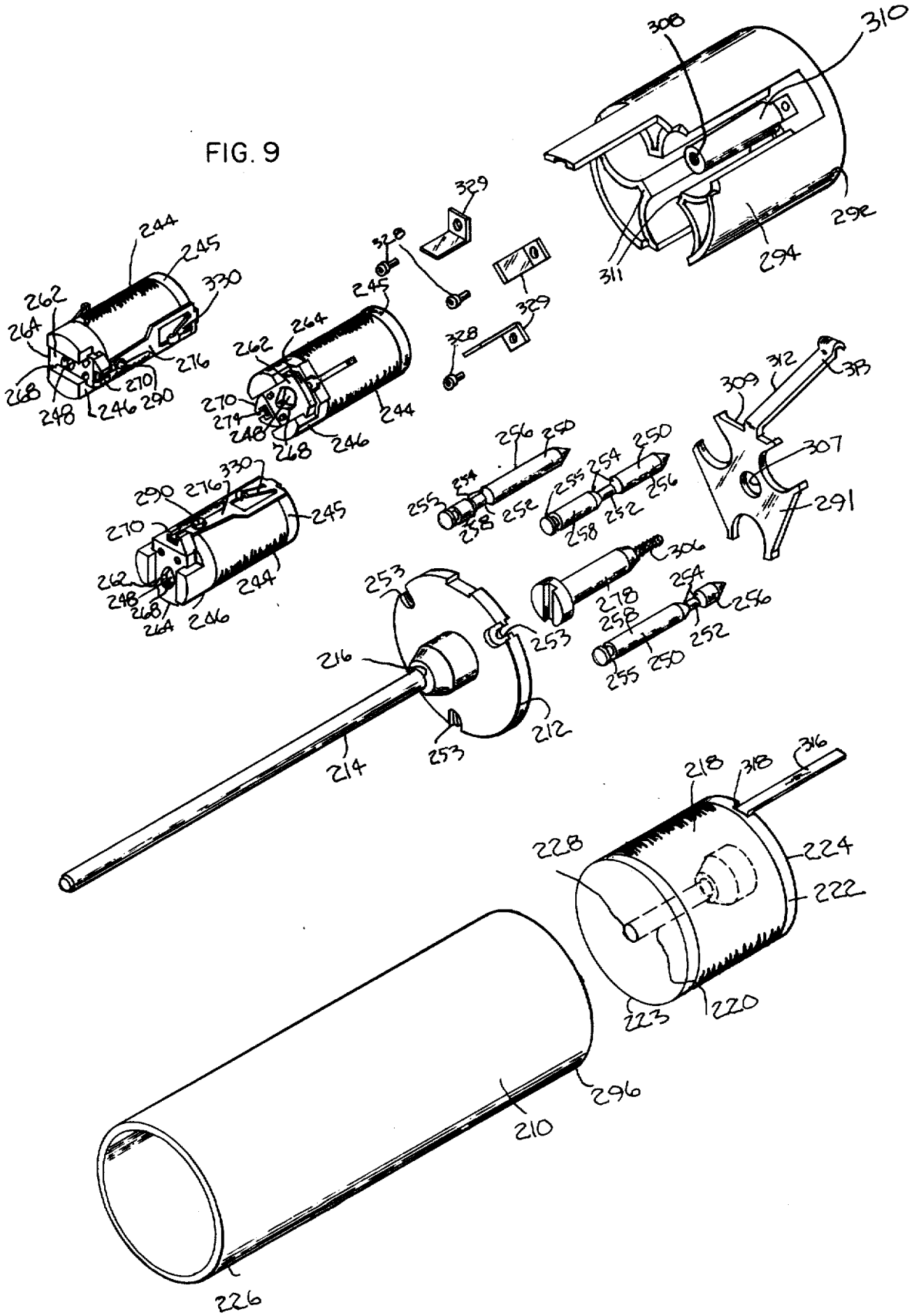

FIGS. 4*a*–4*d* are a series of progressive views illustrating the sequence of operation of the latching mechanism steps accompanying operation of the primary force coil;

FIGS. 5*e*–5*g* are a series of progressive views illustrating the unlatching or delatching steps of the latching mechanism when the latching coil is deenergized;

FIG. 6 is an isometric exploded view of the components which make up the control device of an embodiment;

FIGS. 7 and 8 are sectional views of a further embodiment of the invention; and, FIG. 9 is an exploded isometric view of the components comprising the further embodiment of the control device of FIGS. 7 and 8.

DETAILED DESCRIPTION OF THE INVENTION

Introduction

Figure 1:
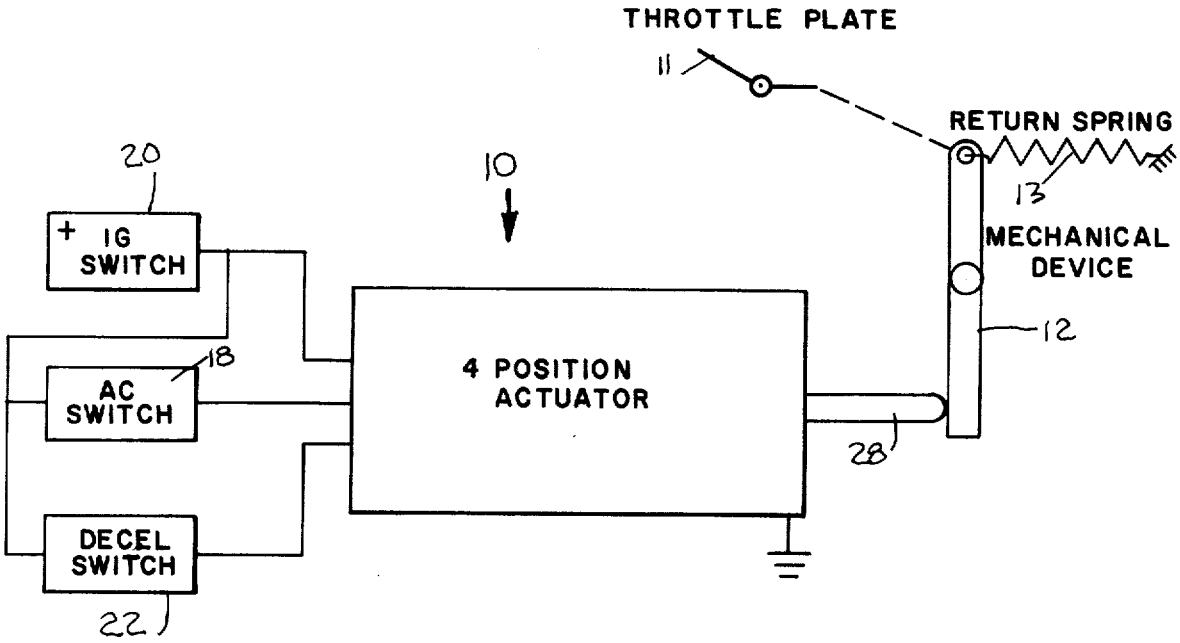
FIG. 1 is a block diagram illustrating the functional relationship of the control device to the throttle linkage which determines the engine speed, and the control device to input controls such as an ignition switch, a deceleration sensor switch and an air conditioning switch.

Referring to FIG. 1, an idle speed control designated generally by reference numeral 10 operates throttle linkage 12 leading to the carburetor throttle plate 11 and its return spring 13 in order to control the idle speed of an engine. Control 10 is responsive to various input parameters including an air conditioning "on-off" switch 18, an ignition "on-off" switch 20, and a deceleration sensor switch 22. All of these are relevant factors in determining the engine idle operation, because, for example, accessories such as an air conditioning compressor operate during idle condition of the vehicle and frequently for long periods of time during typical city traffic driving conditions. Because small, fuel-efficient engines, at normal idle speed, will develop inadequate power to drive the accessories, it is necessary to provide an increase of engine idle speed in order to develop sufficient power to drive these accessories at their maximum output. In the absence of advancing the idle speed in some suitable manner, as for example by the control 10, the engine will stall.

Figure 3:
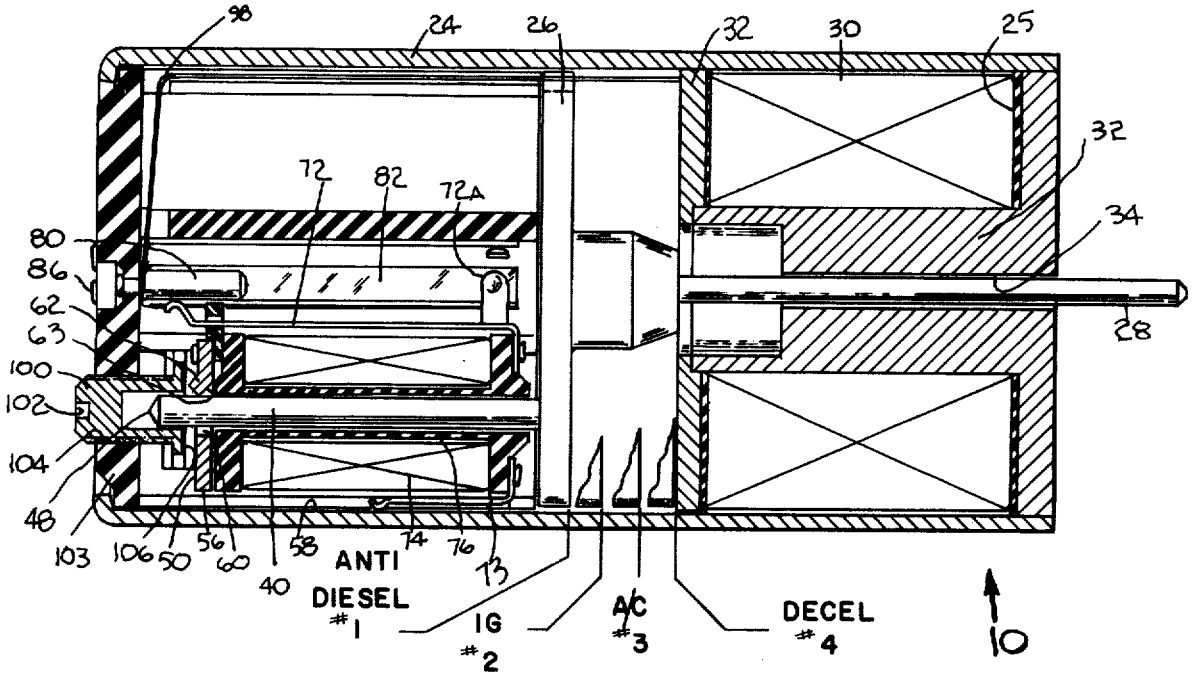
FIG. 3 is a section view of the control device illustrating the armature position: at "anti-diesel" or complete shut down of the engine, at the ignition "on" or normal idle speed position, at the air conditioning "on" position, and at the deceleration "on" position, all of these defining the appropriate throttle positions under these preselected conditions.
Figure 4:
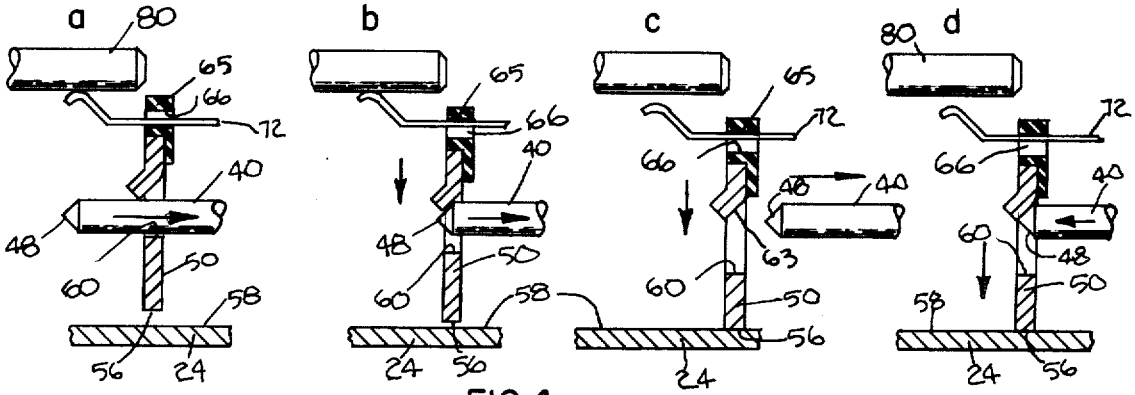

Referring next to FIGS. 1 and 3, a magnetic cylindrical shell 24 has mounted for longitudinal movement therein, a magnetic armature 26 having a nonmagnetic shaft 28 secured to the armature 26 and movable thereby. The shaft 28 has an operative connection to throttle linkage 12 and its return spring 13, and provides a mechanical output for the control 10. Also within the shell 24 is a non-magnetic retainer 25 and a primary force coil or a main coil 30 constituting a primary force coil wound on a magnetic core 32 constituting a pole piece and bobbin portion. The core 32 has an internal through opening 34 which provides a bearing for the non-magnetic shaft 28. The armature 26 has secured to it, through peripheral notches 36, 38, and 39, magnetic latch pins 40, 42, and 44 respectively (see FIG. 6). The connection between the end of a pin and a notch is constituted by a reduced diameter groove 46 in each end of the pins 40, 42, and 44 which slides into the notch and thereafter forms a positive longitudinal connection therewith while permitting limited radial and angular movements relative thereto. Ends 48 of the pins are constituted by tapered smooth surfaces which provide camming surfaces in a manner later to be described. There is associated with each respective latch pin at end 48, magnetic latches 50, 52, 54 spaced equally around the circumference of the shell 24. Each latch has a convexly curved surface 56 designed to be of a radius conforming with that of the inner surface 58 of the shell 24 and a rectangular opening 60 with a struck portion 62 which constitutes a cam follower surface 63 complementary with the associated latch pin extending through the opening 60.

Edge 64 (FIG. 6) of each latch includes an electrical insulation member 65 attached to the latch and having a notch 66 proportioned to receive a resilient switch arm 72 therein, the purpose of the switch arm 72 being to control an electric circuit to the primary force coil 30. Each latch 50, 52, 54 is magnetically responsive to an associated latch coil 74 which is received on a latch coil bobbin 76, the bobbin 76 having a through opening 78 which provides slideable bearing surface for the associated latch pin 40, 42, 44. The resilient switch arm 72 and a ground contact 73 are both mounted on the bobbin 76 and electrically connected to the latch coil 74. The electrical power requirement for the latch coil 74 is quite small, particularly when compared to the electrical power requirement of the primary force coil 30.

Each latch coil is energized by means of a latch coil input terminal 82, each having a mounting flange 84 which is secured by a screw 86 passing through end wall 103 of the retainer 27, there being three such input terminals, one for each latch coil 74.

The electrical circuit for the primary force coil or main coil 30 is from a terminal 82 to resilient switch arm 72, to main coil input post 80, conductor 98, the primary force coil windings 30, then ground to shell 24. The circuit for each latch coil 74 is from a terminal 82 to resilient switch arm 72, to coil winding 74, the ground contact 73, then ground to shell 24.

Each of the latch coil bobbins 76 has an adjustable screw 100 which is externally turned through a slot 102 with a suitable tool such as a screw driver, to advance or retract the screw 100 within an associated threaded opening 104 in the end wall 103 so that the flange 106 will determine the position of the latch coil bobbin and latch and thus the operative position of the latch pin and thereby determine the position of the armature 26 and attached shaft 28 as held against the latch by the return spring, and thus controlling the engine idle speed. The resilient switch arm 72 has a side arm **72*a* wipably contacting the input terminal 82 so that contact will be maintained as the screw 100** is advanced or retracted.

OPERATION

In operation, the primary force coil 30 provides the force to move the armature 26 and nonmagnetic shaft 28 against the return spring to the selected appropriate idle speed throttle position, and at such position the respective latch maintains such position by forming a magnetic coupling with and moving to the inner wall of the shell 24 by reason of energization of the latch coil 74.

Figure 2:
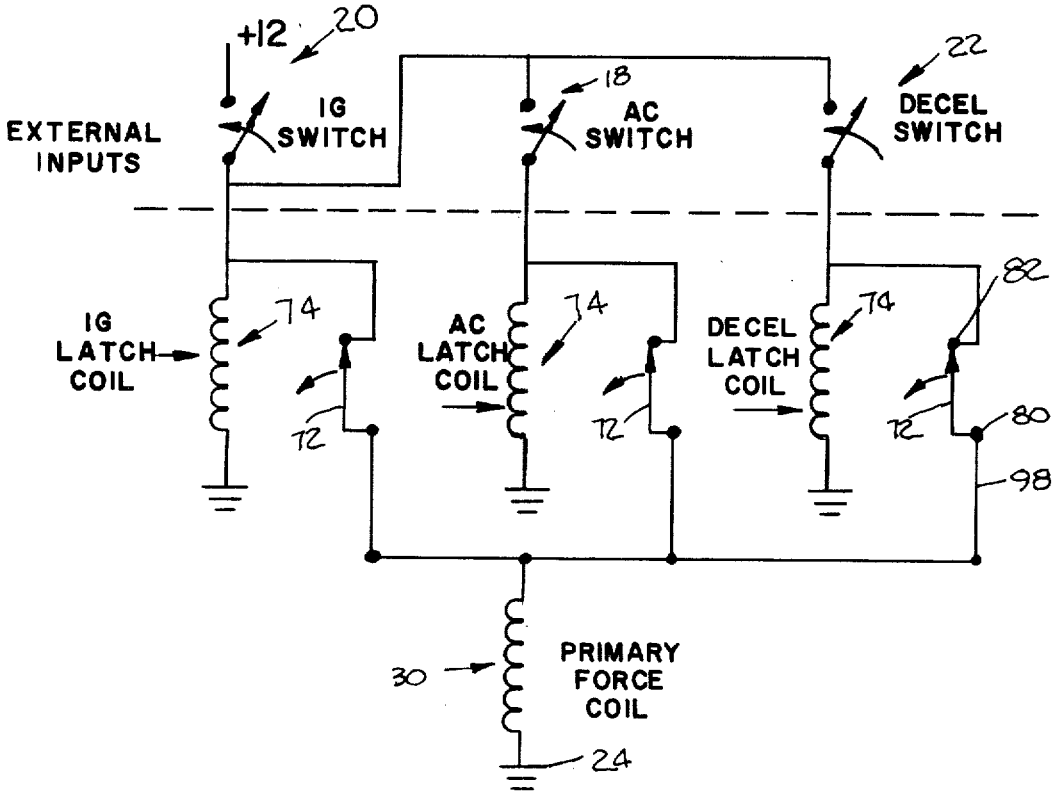
FIG. 2 is a diagram of the electric circuit utilized for energizing the latch coils and the primary force coil and further illustrating the external switches.

One of the latch coils is energized by a deceleration sensing switch 22, another by an air conditioning "on-off" switch 18, and the third by an ignition "on-off" switch 20. As shown in FIGS. 1 and 2, the ignition switch 20 controls the electrical inputs to the air-conditioning and deceleration switches as well as to the ignition latch coil. Thus, with the ignition switch in the "off" mode, no power is provided to the input terminals of the other switches regardless of the other switch states. When the ignition switch is in the "off" mode, none of the latch coils are energized and the position of the armature is determined by the retainer end 111 against which the return spring pushes the armature and which positions the throttle plate to an anti-dieseling position which is a fourth, non-adjustable position of the armature 26.

Referring to FIGS. 1–3, as an example of the operation of the control, assume that the throttle position for idle speed is to be changed from the defined ignition "on" position to the position required during engine deceleration. The deceleration sensing switch 22 changes to an "on" mode which applies power to the deceleration latch coil and the primary force coil 30, the latter being energized through the associated switch arm 72 in contact with input post 80. The main coil electrical circuit is through the decel latch coil input terminal 82, side arm **72*a*, resilient switch arm 72, the main coil input post 80, and conductor 98 to main coil windings of coil 30 to ground with shell 24. The energized primary force coil 30 produces a magnetic force sufficient to cause the armature 26, shaft 28, and latch pins 40, 42, and 44 to move longitudinally against the restoring force of the return spring 13. When sufficient extension of the latch pin associated with the deceleration latch coil has occurred to allow the associated latch to establish a stop for the latch pin, the switch arm 72 will have been pulled away from the input post 80, thus deenergizing the primary force coil 30 and causing shaft movement or extension to cease. As the return spring force acts to bias the shaft 28 toward a retracted position, the latch associated with the energized deceleration latch coil will block the opening 78 causing the associated latch pin end 48 to engage the cam follower surface 63 to stop further retraction and thereby establish the deceleration mode throttle position. This will be clear from reference to FIGS. 4 and 5 which show the latching and delatching in progressive views. The latching pin 40, after having been moved sufficiently to have passed completely out of the opening 60 of the latch 50 (panels "a", "b", "c", FIG. 4), thereby allows the latch 50 to be drawn radially outward toward the shell 24 (panels "b", "c", "d", FIG. 4) due to the magnetic forces developed between it and the inner surface 58 of the shell 24. Magnetization of the latch is provided by the latch coil windings 74 and electrical current provided through the deceleration sensing switch 22 to the appropriate input terminal. The latching coil 74 maintains the latch 50 in a downward position against the inner surface 58 of the shell 24. The restoring spring force (FIG. 1) acting on the armature 26 toward the left, is resisted by engagement of the end 48 of the pin 40 with the cam follower surface 63 (panel "d" FIG. 4), the latch 50** being held by the bobbin to completely resist the spring force on the latch and thereby hold the operative position of the armature and shaft.

Deenergization of the primary force coil is effected when the latch 50 is drawn downward (panel "C" FIG. 4), pulling switch arm 72 away from the primary force coil input post 80 and thus breaking the electrical circuit from the input terminal to ground through the primary force coil windings. At initial magnetization of the latch, the latch cannot move downward until the pin 40 withdraws. As the latch moves and takes up the clearance in the notch 66, the switch arm 72 is pulled downwardly and breaks contact with the main coil input post 80. Latch travel is slightly greater than the amount of the lost motion in the notch, thereby preventing switch oscillation. This occurs in a lag mode, and thus, the main coil remains energized until the pin 40 is completely withdrawn from the opening 60 in the latch 50.

Upon deenergization of the deceleration switch, the restoring spring force returns the armature and attached pin toward the left. The latching coil, once deenergized, terminates the magnetic connection between the shell 24 and the latch 50. The restoring spring force causes the pin 40 to move toward the left and the end 48 of the pin 40, being in engagement with the cam follower surface 63, biases the latch 50 upwardly (panels "e","f", "g", FIG. 5) towards its original position (panel "g", FIG. 5). Switch arm 72 moves upwardly under its own resilience. The switch arm 72 then again engages the main coil input post 80 so that the switch 22 may again be closed to energize the coils.

The remaining switches i.e., the air conditioning switch 18 as well as the ignition switch 20, are effective for establishing in the same manner idle speed settings for the throttle plate 11. The general relationship is that an idle speed predetermined by a particular switch, determines the effective idle speed of the engine. Thus, the appropriate idle speed is provided for each operating condition.

It is an important operative feature that peak power requirement is needed only briefly during the initial setting and once that setting is obtained, only the latching coil is utilized at a much lower power demand. Thus, the unit is unlikely to cause overheating and does not have appreciable waste in power output, requiring only the slight amount necessary to maintain the latched position by a current demand appropriate for the latch coil 74 which is considerably smaller than the main or primary force coil 30. The lost motion connection between the latch and the switch arm prevents oscillation by introducing a lag in the main coil deenergization relative to the latch contacting the shell.

The idle speed defined for each external switch is adjustable by simply externally adjusting the screw 100 by means of a screw driver.

PREFERRED EMBODIMENT OF THE INVENTION

Referring next to the embodiment shown in FIGS. 7 to 9, there is illustrated in isometric exploded view (FIG. 9) a second embodiment of the invention in which there is received within a magnetic shell 210 an armature 212 having an armature shaft 214 secured to the armature 212 through a threaded connection 216. The shaft 214 is operatively connected to a throttle plate 11 or carburetor linkage to control the idle speed.

The armature 212 is displaced by means of a primary force coil 218 which is wound on a pole piece 220 that is part of a bobbin 222 which also serves as a closure at one end 226 of the steel shell 210. Pole piece 220 has through passage 228 which provides a bearing surface for the shaft 214. Just as in the previous embodiment, there are a number (these are any selected number) of latch coils 244 each wound on a bobbin 245 and at the ends of each bobbin are plastic end members 246. Each bobbin 245 further includes a through passage 248 which provides a bearing surface for latch pin 250 having a centrally disposed groove 252 with inclined surfaces 254 and lands 256 and 258. Inclined surfaces 254 act as cam surfaces which bear against complementary faces 260 of a latch 262 (FIG. 8). Each latch has a curved surface 264 which is of sustantially the same radius as the inner surface 266 of shell 210 so that when the latch coil 244 is energized, the latch will be drawn radially toward and then contact the shell when the groove 252 of the latch pin 250 is registered with opening 268 in the latch 262, thereby providing a stop which holds the armature 212 and the shaft 214 in the appropriate idle position. Each latch pin 250 is fastened to the armature 212 at equally spaced circumferential intervals through a notch 253 in the armature and annular groove 255 in the pin 250. This type of connection permits articulation between the parts.

Latch 262 has electrical insulation member 270 (FIG. 8) which is attached by pins 272 and includes stepped notch 274 which forms a key connection with a switch leaf spring 276. The thickness of the switch leaf spring 276 in relation to the height of the notch 274 provides a clearance such that the switch 276 is disengageable from connector pin 278 when the latch 262 is pulled radially through a distance "D" (FIG. 7) which is slightly greater than the height of stepped notch 274. Thus, when the latch 262 is magnetically attracted toward the shell, the switch leaf spring 276 will contact the upper edge 280 of the notch and then be pulled radially by the additional amount necessary to fully disengage the contact button 290 on the switch leaf spring 276 and break the electrical connection with the primary force coil 218. The oversized opening of notch 274 precludes oscillation which would occur if the switch leaf spring 276 disengaged as soon as the latch 262 began to move in a radial direction towards inner surface 266 of the shell 210.

The latch 262, since it is restrained from longitudinal motion by the bobbin 245, serves as a positive stop for the armature 212 through the latch pin and also serves to interrupt the circuit to the primary force coil 218. As shown in FIG. 7, which is the sectional view of this embodiment, there is a retainer 292 made of any suitable plastic composition which is staked, threaded or otherwise suitably secured at its outer periphery 294 within the end 296 of the shell 210. The three subassemblies of latch-coil-bobbin are clamped in position against movement by means of an electrically conductive hold down plate 291, the plate 291 being secured by switch pin 278 having a threaded end 306 passing through opening 307 and into opening 308 of part 310 formed integrally with the retainer 292. Thus each subassembly is clamped in place in its operative position with plate face 309 held against surface 311 of retainer 292. Each latch-coil-bobbin assembly permits the necessary radial movement of the latch 262 and longitudinal movement of the latch pin 250 relative to the latch coil 244.

As in the previous embodiment, the latch pins 250 have grooved ends 255 which are received in notch sections 253 of the armature 212 to allow limited articulated free movement sufficiently so that the latch pins will easily enter and slide within the central passageways 248 of the bobbin 245.

In FIG. 7, the circuit to energize the primary coil 218 is constituted by a conductive inlet through the retainer 292 provided by a staked rivet 328, then to terminal post 329, raised portion 330 of switch leaf spring 276 attached to the bobbin 245 through screw 340, leaf spring 276 to contact button 290, switch pin 278, plate 291, contact arm 312, contact arm head 313, conductor 316, terminal 318 to primary force coil 218 and then to ground through the shell 210. The latch coil 244 is energized by means of an electrical circuit comprising rivet 328, terminal 329, raised portion 330 of switch leaf spring 276 attached to bobbin 245, coil 244, contact 380, arm 382, ground contact 384, and ground to steel shell 210. All the latch coils are electrically connected to the switch pin 278 so that when one rivet 328 is energized, all latch coils are energized until switching occurs. Referring to FIGS. 7 and 8, when the armature 212 moves sufficiently to the right bringing the groove 252 into registry with opening 268 of the latch pin 250, latch 262 is drawn downwardly by energization of the latch coil 244 through the distance "D", and this distance being in excess of the width "$D_1$" of the notch 274, draws the switch leaf spring 276 away from the switch pin so that the contact button 290 separates from the switch pin 278 thereby de-energizing the primary force coil 218. The latch coil 244 remains energized, and continues to produce a magnetic coupling between the curved surface 264 of the latch 262 and inner surface 266 of the steel shell 20. Restoring force applied to the armature 212 by an external spring associated with the carburetor or throttle plate is opposed by engagement of face 260 with surface 254 and latch 262 with bobbin 245 (FIGS. 7, 8). The magnetic coupling of the latch with the shell and the engagement of the complementary face with the inclined surface and latch with the bobbin will prevent the armature 212 from moving toward the left.

It is an important part of the present invention that the flux generated by the primary force coil 218 is additive with the flux developed by the latch coil and assists the latch coils 244 in pulling the latches 262 downwardly so that immediately upon energization of the primary coil 218 and a latch coil 244, there is a considerable magnetic coupling force developed between a latch 262 and the steel shell 210. Because the relative movement permitted between the notch 274 and the switch leaf spring 276 ("$D_1$") as compared with its distance "D" between the curved surface 264 and inner surface 266, there is precluded "hunting" or oscillation in operation of the coil 218.

Once the latch coil 244 is deenergized by means of opening a deceleration switch, turning off the air conditioning, or turning off the ignition switch, the external spring (not shown) will displace the armature 212 toward the left. The armature 212 then bottoms on the surface 311 of the retainer 292, this being the position which prevents "dieseling" of the engine. The latch pins 250 raise the latches 262 upwardly bringing the contact buttons 290 once again into contact with the switch pin 278 so that the primary coil 218 can again be reenergized.

Each of the three latch pins 250 has a different location of groove 252 relative to its length, and this differential location, one relative to the other, defines the position at which the respective latch 262 becomes operative and in turn defines the respective latched positions for the armature 212 and shaft 214.

OPERATION

The principle of operation is the same as in the previous embodiment, i.e. the primary coil 218 is energized for a short interim period to displace the latch pins 250 and position the components in an appropriate idle speed-position. Once the idle position is achieved, the position is held by the latch 262 which is drawn downwardly because groove 252 of the latch pin permits the latch 262 to move downwardly and magnetically couple with the shell 210. As the latch moves downwardly through the distance "D" (FIG. 7), the primary coil 218 is deenergized as previously described by switch leaf spring 276 being pulled downwardly and disengaging contact button 290 from switch pin 278. This idle position is held until the latch coil 244 associated with the particular latch 262 is deenergized by opening of the respective switch 18, 20, and 22 (FIG. 2) and the external spring (not shown) biases the armature 212 to the left to the original position. As this occurs, the inclined surface 254 of the pin 250 raises the latch 262 permitting the switch leaf spring 276 to reestablish electrical contact between the button 290 and the switch pin 278 whereby an electrical circuit can again be established to the primary force coil 218 when any one of the switches 18, 20, 22 (FIG. 2) is closed.

It is an important feature of the present invention that a lead of the primary force coil 218 is soldered to the pole piece 220 of bobbin 222 for grounding to shell 210 so that all of the space between the pole piece and the end plates 223 and 224 can be occupied by coils thus increasing the strength of the primary force coil.

Protection against overheating of the primary coil 218 can be provided by modifying the unit as described. The contact arm 312 can comprise a bimetal arm resiliently biased into contact with conductor 316. Thus, the primary coil 218 can be deenergized because the contact arm 312 is a bimetal circuit breaker which forms a part of the electrical circuit to the primary coil 218. If the contact arm 312 is heated sufficiently, it will separate the contact arm head 313 from conductor 316 and disable the primary coil 218.

CONCLUSION

Although the present invention has been illustrated and described in connection with selected example embodiments, it will be understood that these are illustrative of the invention and are by no means restrictive thereof. It is reasonably to be expected that those skilled in this art can make numerous revisions and adaptations of the invention and it is intended that such revisions and adaptations will be included within the scope of the following claims as equivalents of the invention.

What is claimed as new and desired to be secured by Letters Patent of the United States is:

1. An apparatus for selectively positioning a control device, comprising a housing, a positioning coil, a movable armature displaceable within said housing responsive to the energization of said positioning coil and including means forming a mechanical connection with the control device, a plurality of positioning means operatively secured to said armature and disposed circumferentially relative thereto within said housing, a holding coil operatively associated with each said circumferentially disposed positioning means and including locking means actuated upon energization of said holding coil to form a magnetic coupling with said housing thereby retaining the associated circumferentially disposed positioning means and maintaining said armature at a longitudinal position within said housing, means selectively actuating said holding coils and positioning coil to effect longitudinal positions of the armature and positioning means, and means for deactuating said positioning coil when a locking means has formed a magnetic coupling with said housing.

2. The apparatus in accordance with claim 1, including means for adjusting the respective longitudinal positions of said positioning means.

3. The apparatus in accordance with claim 1, including resilient means opposing the longitudinal motion of said armature and effectively determining a position of said armature when the holding coils and positioning coil are deenergized, the position being effective for anti-dieseling of an engine.

4. The apparatus in accordance with claim 1, wherein resilient means for opposing longitudinal positioning of the armature effectively determines longitudinal positions of said armature when the positioning coil is deenergized and the holding coil are sequentially deenergized.

5. The apparatus in accordance with claim 1, further comprising a centrally disposed post, resilient switch arms self-biased into engagement with said post and thereby effecting electrical connection with said positioning coil, the locking means comprising magnetizable latching means each including an operative coupler engageable with a respective resilient switch arm, the latching means displaced radially outward into engagement with the interior surface of said housing upon energization of the respective holding coil, and positioning means for biasing said latching means radially inwardly when the means selectively actuating the respective holding coil is deenergized.

6. The apparatus in accordance with claim 1, in which an adjustable means provides a range of longitudinal positions of said armature, and a shaft extending from said armature is coupled with means for controlling air/fuel flow to an engine.

7. The apparatus in accordance with claim 1, further comprising a retaining means disposed within said housing for containing said holding coils, positioning means, and locking means.

8. The apparatus in accordance with claim 7, wherein the retaining means provides a stop for said armature when said positioning coil and holding coils are deactuated.

9. The apparatus in accordance with claim 8, further comprising a plate for securing said holding coils, locking means, and means for deactuating said positioning coil within said retaining means.

10. The apparatus in accordance with claim 1, further comprising a means for deenergizing the positioning coil when said coil exceeds a predetermined temperature.

11. The apparatus in accordance with claim 1, wherein said locking means includes a coupler engageable with said means for deactuating said positioning coil, said coupler preventing oscillation of said means.

12. A process for defining the idle position of a throttle responsively to various conditions such as idle speed with substantial power demand, ignition, deceleration, and full stop, comprising the steps of mechanically displacing a shaft through an armature responsive to a primary force coil, opposing such movement of the armature with a resilient biasing means, selectively defining mechanical displacement positions of said armature by forming transient magnetic/mechanical couplings between one of a plurality of latching means and the interior surface of a casing through selective energization of latch coils associated therewith, and switch means responsive to the displacement of said latching means by said latch coil to effect deenergization of said primary force coil whereby the armature is thereafter held in a displacement position defined by a latching means of one of said latch coils against the retraction movement of said resilient biasing means, and controlling the engine speed responsively to the position of the shaft displaced by said armature.

13. The process in accordance with claim 12, including the step of adjustably positioning a respective latching means thereby concurrently determining the position where the primary force coil is deenergized and the magnetic/mechanical coupling effectively opposes the resilient biasing means retracting the armature toward the stop defined by said latching means.

14. The process in accordance with claim 12, including the step of biasing the respective latching means in a retraction direction for effecting a circuit for energizing said primary force coil, and thereafter deenergizing the magnetic coupling between the respective latching means and the interior surface of said casing thereby releasing the latching means to effect retraction movement of the armature and shaft.

15. The process in accordance with claim 12, in which said armature is held in said displacement position by a positioning means operatively secured to said armature and abutting against said latching means.

16. The process in accordance with claim 12, including the step of disposing said latch coils, latching means, and switching means within a retainer contained in the casing wherein the functions of magnetic coupling and uncoupling are completed.

17. The process in accordance with claim 12, including the step of deenergizing the primary force coil when said coil exceeds a predetermined temperature.

18. The process in accordance with claim 12, wherein the idle position defined for said full stop condition is effective for anti-dieseling of an engine.

19. The process in accordance with claim 12, in which said latching means prevents oscillation of said switch means.

* * * * *